US007612246B2

(12) United States Patent
Broutin et al.

(10) Patent No.: US 7,612,246 B2
(45) Date of Patent: Nov. 3, 2009

(54) PROCESS FOR ISOMERIZATION OF A C7 FRACTION WITH CO-PRODUCTION OF AN AROMATIC MOLECULE-RICH FRACTION

(75) Inventors: Paul Broutin, Chaponost (FR); Dominique Casanave, St. Symphorien d'Ozon (FR); Jean-Francois Joly, Lyons (FR); Elsa Jolimaitre, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 818 days.

(21) Appl. No.: 11/232,108

(22) Filed: Sep. 22, 2005

(65) Prior Publication Data

US 2006/0106266 A1 May 18, 2006

(30) Foreign Application Priority Data

Sep. 22, 2004 (FR) ..... 04 09999

(51) Int. Cl.
*C07C 5/13* (2006.01)
*C07C 7/10* (2006.01)

(52) U.S. Cl. ..... 585/737; 585/818; 585/819; 585/820; 585/833

(58) Field of Classification Search ..... 585/737, 585/818, 819, 820, 833
See application file for complete search history.

(56) References Cited

U.S. PATENT DOCUMENTS

| | | | | |
|---|---|---|---|---|
| 4,168,209 | A * | 9/1979 | Mikitenko et al. | 203/2 |
| 4,982,048 | A * | 1/1991 | Stem et al. | 585/751 |
| 5,139,645 | A | 8/1992 | Maxwell et al. | |
| 5,643,442 | A * | 7/1997 | Sweet et al. | 208/302 |
| 6,338,791 | B1 | 1/2002 | Ragil et al. | |
| 6,600,082 | B2 * | 7/2003 | Le Peltier et al. | 585/434 |
| 2002/0040176 | A1 * | 4/2002 | Baird et al. | 585/700 |
| 2002/0175109 | A1 * | 11/2002 | Ragil et al. | 208/63 |

FOREIGN PATENT DOCUMENTS

EP 0462673 12/1991

* cited by examiner

*Primary Examiner*—Thuan Dinh Dang
(74) *Attorney, Agent, or Firm*—Millen, White, Zelano & Branigan, P.C.

(57) ABSTRACT

Process for the production of a RON isomerate that is at least equal to 80 and that contains less than 1% by weight of aromatic compounds and for co-production of an aromatic fraction that for the most part contains toluene, starting from a fraction with 7 carbon atoms containing paraffins, aromatic compounds and naphthenes.

15 Claims, 3 Drawing Sheets

PROCESS FOR ISOMERIZATION OF A C7 FRACTION WITH CO-PRODUCTION OF AN AROMATIC MOLECULE-RICH FRACTION

FIELD OF THE INVENTION

The elimination of lead alkyls in automobile gasolines and more recently the limitation of aromatic compound contents in the gasolines (35% in 2005 compared to 42% currently) generated a development of production processes of branched paraffins that have a much better octane number than the linear paraffins and in particular the process for isomerization of normal paraffins into branched paraffins.

This process is currently taking on a growing importance in the petroleum industry.

The current schemes for upgrading naphtha ($C_5$-$C_{10}$ fraction) obtained from the atmospheric distillation of the petroleum most often comprise a fractionation that produces:

- a light naphtha ($C_5$-$C_6$ fraction) that is sent to isomerization,
- a heavy naphtha ($C_7$-$C_{10}$ fraction) that is sent to catalytic reforming.

The isomerization product (or isomerate) is free of aromatic compounds contrary to the reformate that in general contains a large amount thereof due to the reactions for dehydrocyclization of paraffins and for dehydrogenation of naphthenes.

Isomerate and reformate are usually sent to the gasoline pool in which other bases, such as the gasoline that is obtained from fluidized-bed catalytic cracking (FCC) or additives such as methyl-tert-butyl ether (MTBE), can also be produced.

The aromatic compounds have high octane numbers that are favorable to their use in controlled-ignition engines, but for environmental reasons, their total content in the gasolines is increasingly limited.

From 2005, the European specification calls for reducing to a maximum of 35% by volume the total content of aromatic compounds in the super fuels, whereas currently said content is on the order of 42% by volume.

Also, it is imperative to develop new processes that make it possible to synthesize gasoline bases that are free of aromatic compounds but that have high octane numbers.

This invention relates more particularly to the isomerization of the $C_7$-rich fraction that is obtained from the atmospheric distillation of naphtha.

Table 1 below provides the research octane number (RON) and the boiling points of the primary hydrocarbon compounds that are present in the C7 fraction that is obtained from the atmospheric distillation of naphtha:

TABLE 1

| | RON | $T_{b.p.}$ (° C.) |
|---|---|---|
| Trimethyl 2-2-3 butane | 112.1 | 80.8 |
| Dimethyl 2-2 pentane | 92.8 | 79.2 |
| Dimethyl 2-4 pentane | 83.1 | 80.5 |
| Dimethyl 3-3 pentane | 80.8 | 86 |
| Dimethyl 2-3 pentane | 91.1 | 89.7 |
| Methyl-2 hexane | 42.4 | 90 |
| Methyl-3 hexane | 52 | 91.9 |
| Ethyl-3 pentane | 65 | 93.4 |
| n-Heptane | 0 | 98.4 |
| Dimethyl-1,1 cyclopentane | 92.3 | 87.8 |
| cis-Dimethyl-1,3 cyclopentane | 79.2 | 90.8 |
| trans-Dimethyl-1,3 cyclopentane | 80.6 | 91.7 |
| trans-Dimethyl-1,2 cyclopentane | 80.6 | 91.8 |
| Methyl-cyclohexane | 74.8 | 100.9 |

TABLE 1-continued

| | RON | $T_{b.p.}$ (° C.) |
|---|---|---|
| Ethyl-cyclopentane | 67.2 | 103.4 |
| Toluene | 120 | 110.7 |

The consideration of octane numbers of different $C_7$ isomers shows that the isomers of normal-heptane (n-$C_7$) have several branches, i.e., the di- and tri-branched isomers have an octane number (from 80 to 110) that is high enough to be able to be sent directly into the gasoline pool.

In contrast, the isomers that have only a single branch or are mono-branched have octane numbers (42 for methyl-2 hexane; 52 for methyl-3 hexane) that are inadequate for being mixed in the gasoline pool.

These compounds should therefore be transformed as much as possible into di- or tri-branched paraffins in the isomerization process.

Regarding the normal-heptane, whereby its octane number is zero, it absolutely must be converted until used up in the isomerization process.

It can be tolerated up to 1% by weight of nC7 in the isomerate and, if possible, less than 0.5% by weight.

Furthermore, the toluene that is present in the fresh feedstock can be totally hydrogenated into methyl-cyclohexane (MCH), either in a specific hydrogenation unit or in the unit for isomerization of paraffins that have a hydrogenating function.

This latter possibility is not desirable, however, because the toluene has an excellent RON contrary to that of MCH, and it may therefore be advantageous to isolate it either for use as solvent or as a petrochemical base, or with a view to reintroducing it into the gasoline pool as improving the octane number to a content allowed by the specifications.

The methyl-cyclohexane (MCH) that is present in the feedstock in a relatively large amount is not very affected by the isomerization, whereby the isomerization catalysts do not promote the opening of naphthene rings in their usual conditions of use.

Now, the $C_7$ feedstock can contain up to 30% by weight of methyl-cyclohexane, a compound whose RON is less than 75, which further significantly increases the RON of the $C_7$ isomerate that is obtained.

It may therefore be advantageous to employ a ring-opening unit that will essentially convert the MCH into normal and branched paraffins and will send these paraffins toward the isomerization unit.

It may also be advantageous to convert the naphthenes into aromatic compounds in a unit for specific dehydrogenation and then to extract the aromatic compounds that are obtained so as to send only the paraffins to the isomerization.

The two possibilities mentioned above are quite obviously exclusive of one another since there would be no sense in using a reactor for opening the naphthene rings if the latter were converted in advance into aromatic compounds and then eliminated.

The various possibilities are part of this invention and will be presented later as variants.

The problem that this invention seeks to solve is therefore that of the production of gasoline bases from a $C_7$ fraction that corresponds to a research octane number (RON) of at least 80, with a limited content of aromatic compounds, which makes it possible to anticipate the new regulation on the specifications of the gasoline pool.

The solution that is proposed in this invention consists of a process for treatment of a C7 fraction, generally obtained from an atmospheric distillation so as to obtain two fractions:

- a first fraction that for the most part contains paraffins and naphthenes that is sent into an isomerization unit, and
- a second fraction that for the most part contains aromatic compounds and in particular toluene, which, according to requirements, can be updated as solvent, as a base for petrochemistry, or can be reintroduced at least in part into the gasoline pool, while adhering to the specification on the final aromatic compound content.

The isomerization unit produces effluents that for the most part are paraffinic, and it is possible to treat them in a unit for separating normal paraffins and mono-branched paraffins, on the one hand, and di- and tri-branched paraffins, on the other hand, so as to recycle until used up the normal paraffins and mono-branched paraffins at the top of the isomerization unit.

The amount of naphthenes that it is possible to allow into the feedstock at the inlet of the isomerization is only limited by the RON of the isomerate produced.

In practice, the naphthene content in the starting feedstock upon isomerization is approximately 20% by weight for most of the C7 feedstocks that are obtained from an atmospheric distillation naphtha.

In the case where the naphthenic compound content would be too high, it will always be possible to use the variant consisting in dehydrogenating in advance the naphthenes into aromatic compounds where it takes into account the opening of the napthene rings, as will be explained later.

One of the advantages of the invention is specifically, by using the adapted variant, to be able to treat a C7 feedstock having any distribution of paraffins, naphthenes and aromatic compounds. The invention therefore makes it possible to obtain an isomerate containing a majority of di- and tri-branched paraffins whose RON can easily reach 80 or more.

By incorporating in this isomerate limited amounts of aromatic compounds, in particular of the toluene that is extracted upstream from the isomerization unit, it is possible to carry the RON up to values of 85 or more.

EXAMINATION OF THE PRIOR ART

The separation between the aromatic compounds and the paraffins can be done either by extraction with solvent, or by extractive distillation.

There are many patents using these techniques to extract benzene and/or toluene. By way of examples, we will cite U.S. Pat. No. 5,723,026; U.S. Pat. No. 4,168,209; and U.S. Pat. No. 3,884,769.

In the case where the separation is carried out by extraction with solvent, implementation of the membrane contactor type may be used.

Other techniques for separation can also be considered:

- By adsorption on zeolites or activated carbon, silica gel, alumina or polymer adsorbents. Takahashi et al. in AIChE Journal, 48(7), pp. 1457-1468, 2002 showed that faujasite-type zeolites selectively adsorb the aromatic compounds.
- By separation on a membrane, the membrane materials that are used being able to be mineral materials (for example, of zeolitic type) or polymers. U.S. Pat. No. 5,643,442; U.S. Pat. No. 5,635,055 and U.S. Pat. No. 6,187,987 propose, for example, separating the aromatic compounds selectively thanks to a polyimide membrane.

Yoshikawa and Tsubouchi published a study in the journal "Separation Science and Technology," 35 (12), pp. 1863-1878, 2000 that shows that grafted copolymer membranes could also make this separation possible.

Faujasite-structural-type zeolite membranes also have a good selectivity with regard to aromatic molecules, as described in the articles by Nair et al. in Microporous and Mesoporous Materials, 48, pp. 219-228, 2001, and de Jeong et al. in Separation Science and Technology, 37 (6), pp. 1225-1239, 2002.

Liquid membranes can also be used as described by A. L. GOSWAMI and B. RAWAT in Journal of Membrane Science, No. 24, 145 of 1985.

There are relatively few patents that relate to the development of the C7 fraction by isomerization, most of them relating to the treatment by isomerization of C5-C6 fractions. In addition, none of these processes makes possible the simultaneous production of an aromatic fraction.

U.S. Pat. No. 6,069,289 describes a process for separation of multi-branched paraffins, optionally coupled to an isomerization, but the treated feedstock does not contain naphthenic compounds and aromatic compounds.

U.S. Pat. No. 6,338,791 describes a separation process that is coupled to an isomerization reactor.

The separation process makes it possible to produce a fraction that is rich in multi-branched paraffins and optionally rich in saturated or unsaturated cyclic compounds. This process makes it possible to produce a single fraction because the naphthenes and aromatic compounds of the feedstock are not separated from paraffins and are introduced mixed with the paraffins in the isomerization reactor.

SUMMARY DESCRIPTION OF THE FIGURES

SUMMARY PRESENTATION OF THE INVENTION

Figure 1:
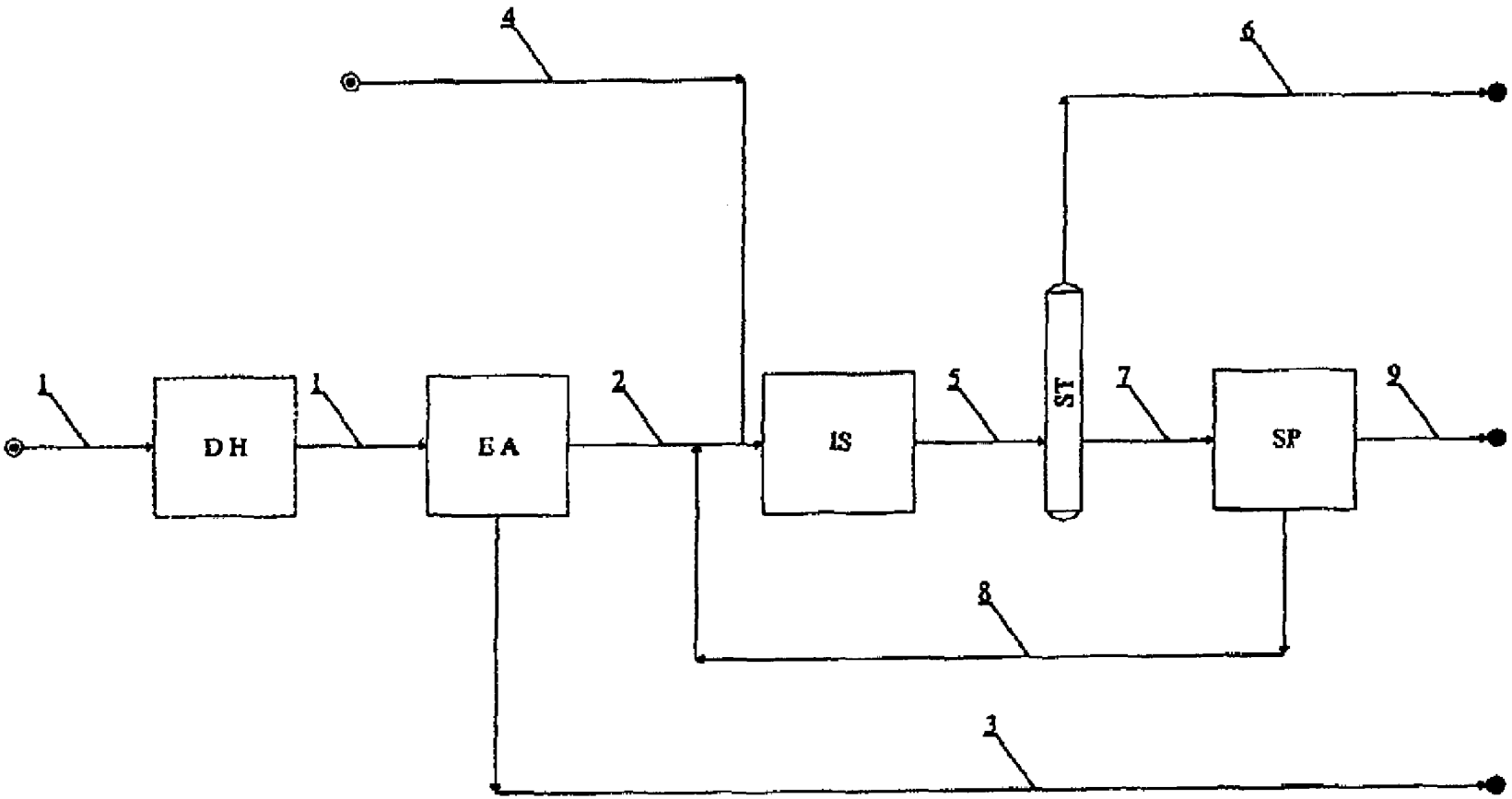
FIG. 1 shows a process diagram according to the invention that does not contain a distillation column.

This invention should be replaced in the more general context of treatment of the naphtha fraction that is obtained from the atmospheric distillation of the crude.

The naphtha fraction is generally separated into 3 fractions in a distillation column:

1) A top fraction that essentially comprises the compounds with 5 and 6 carbon atoms that is sent into a specific isomerization whose operating conditions and whose catalyst can be different from those used for the isomerization of the $C_7$ fraction.
2) A fraction with 7 carbon atoms that is the subject of the treatment described in this invention and that ends with an effluent with 7 carbon atoms containing at least 70% by weight of di- and tri-branched paraffins, and whose octane number is between 80 and 87.
3) A bottom fraction essentially containing compounds with 8 carbon atoms and more that is sent into a catalytic reforming unit.

This invention relates to the treatment of the fraction with 7 carbon atoms that is obtained from the preceding fractionation, but, given the performance levels of the naphtha fractionation column, it may be possible to find in said $C_7$ fraction up to 10% of lighter compounds with 6 carbon atoms or less and up to 10% of heavier compounds with 8 carbon atoms and more.

This invention takes into account these compounds that are adjacent to the C7 fraction itself that will henceforth be called "C7 fraction" for the sake of simplicity.

This invention therefore relates to a process for the production of multi-branched paraffins with 7 carbon atoms starting from a feedstock that for the most part comprises hydrocarbons with 7 carbon atoms, making it possible to obtain:

An isomerate that has an octane number that is at least equal to 80 with a content of aromatic compounds that is less than 1% by weight, and preferably less than 0.5% by weight.

An aromatic fraction that for the most part consists of toluene that can be used as a solvent or a petrochemical base or can be reintroduced into the gasoline pool in proportions that are compatible with the specification on the content of aromatic compounds.

In general, the C7 fraction will have a composition that is located in the following ranges for the primary compounds:

Normal-heptane of 20 to 40% by weight

Methyl-2 hexane of 5 to 15% by weight

Methyl-3 hexane of 10 to 20% by weight

Methyl-cyclohexane of 5 to 30% by weight

Toluene of 4 to 15% by weight.

All of the paraffins therefore represent 55 to 90% by weight of the fraction, the methylcyclohexane 5 to 30% by weight, and the toluene 4 to 15% by weight.

The transformation of the initial C7 fraction into the final C7 fraction that consists of a majority of di- and tri-branched paraffins will be obtained by the linking of the following stages:

1) The extraction of the aromatic compounds of the C7 feedstock that will leave a C7 fraction that subsequently contains only paraffins and naphthenes.
2) The transformation of normal paraffins into branched paraffins and mono-branched paraffins into multi-branched (di- and tri-branched) paraffins, which is carried out in an isomerization unit that operates under partial hydrogen pressure.
3) The separation of normal paraffins and mono-branched paraffins, on the one hand, and di- and tri-branched paraffins, on the other hand, can be carried out by distillation or by a process of separation by adsorption in, for example, a PSA-type unit (Pressure Swing Adsorption that it is possible to translate per unit of adsorption by pressure variation) or of a simulated counter-current type (CCS) so as to recycle normal and mono-branched paraffins toward the isomerization unit.
4) Optionally, the selective dehydrogenation of naphthenes into aromatic compounds that will be done upstream from the extraction of aromatic compounds.
5) Optionally and alternately to option 4, a unit for opening naphthene rings that makes it possible to convert the latter into linear or mono-branched paraffins that will be sent to the isomerization unit.

The invention applies to a C7 fraction that is obtained from an atmospheric distillation naphtha, but more generally it applies to a C7 fraction that has any proportions of paraffins, naphthenes and aromatic compounds.

Any proportions is defined as any proportion set in which the paraffin, napthene and aromatic compound families are present without their content being limited.

This invention is therefore defined as a process for the production of a RON isomerate that is at least equal to 80, and for co-production of an aromatic fraction that consists for the most part of toluene, starting from a fraction that consists of hydrocarbons with 7 carbon atoms containing paraffins, naphthenes and aromatic compounds in any proportion, whereby said process employs at least one unit for extracting aromatic compounds contained in the feedstock, at least one isomerization unit, and at least one unit for separating linear paraffins and mono-branched paraffins, on the one hand, and di- and tri-branched paraffins, on the other hand, characterized in that the isomerate that is produced contains less than 1% by weight of aromatic compounds and preferably less than 0.5% by weight of aromatic compounds.

According to a first variant of the invention, fresh feedstock (1) is introduced into a unit for extracting aromatic compounds (EA) that makes it possible to produce, on the one hand, an aromatic fraction that for the most part contains toluene (3), and, on the other hand, a dearomatized C7 fraction (2) that is sent as a feedstock of an isomerization unit (IS) whose effluent, after stabilization (5), is introduced into a separation unit (SP) from which there are extracted, on the one hand, linear and mono-branched paraffins (8) that are recycled at the inlet of isomerization unit (IS) mixed with effluent (2) that is obtained from the extraction unit of aromatic compounds (EA), and, on the other hand, a flow (9) that is rich in di- and tri-branched paraffins that constitutes the produced isomerate.

According to a second variant of the invention, fresh feedstock (11) is introduced into a unit for extraction of aromatic compounds (EA) that makes it possible to produce, on the one hand, an aromatic fraction (23) that for the most part contains toluene, and, on the other hand, a dearomatized C7 fraction (12) that is introduced into a distillation column (CD) from which are extracted:

a) A top flow (13) that constitutes the isomerate that is produced b) A bottom flow (15) that feeds isomerization unit (IS)

whereby after stabilization, effluent (18) from the isomerization unit is recycled to distillation column (CD) at a level that is located above the feed level of the column.

According to a variant of the preceding, fresh feedstock (11) is introduced into a unit for extracting aromatic compounds (EA) that makes it possible to produce, on the one hand, an aromatic fraction (23) that for the most part contains toluene, and, on the other hand, a dearomatized C7 fraction (12) that is introduced into a distillation column (CD) from which are extracted:

a) A top flow (13) that constitutes the isomerate that is produced b) A lateral flow (14) that feeds isomerization unit (IS)

c) A bottom flow (15) that feeds isomerization unit (IS) mixed with lateral flow (14)

whereby after stabilization, effluent (18) of the isomerization unit is recycled to distillation column (CD) at a level that is located above the outlet level of lateral flow (14).

According to a variant that can be applied when the process according to the invention comprises a distillation column, top flow (13) of distillation column (CD) is sent into a unit (SP) for separating normal and mono-branched paraffins, on the one hand, and di- and tri-branched paraffins, on the other hand, whereby the normal and mono-branched paraffins (21) are reintroduced into isomerization unit (IS), and the di- and tri-branched paraffins (20) constitute the isomerate.

According to a third variant of the invention, bottom flow (15) of distillation column (CD) is sent into a unit for opening naphthene rings (OC) from which is extracted an effluent (16) that is sent to isomerization unit (IS).

According to a variant that constitutes a subvariant of the preceding, bottom flow (15) of distillation column (CD) is sent into a unit for opening naphthene rings (OC) from which is extracted an effluent (16) that is sent to feed column (CD) mixed with flow (12).

Distillation column (CD) advantageously can be of the column type with an internal wall.

The unit for separating linear and mono-branched paraffins, on the one hand, and di- and tri-branched paraffins, on the other hand, can be produced by a PSA-type adsorption process.

In other cases, the separation of linear and mono-branched paraffins, on the one hand, and di- and tri-branched paraffins, on the other hand, can be carried out by an adsorption process of simulated countercurrent type (CCS).

The extraction of aromatic compounds (EA) can be carried out by means of a solvent.

In other cases, the unit for extracting aromatic compounds (EA) can be carried out by extractive distillation.

In other cases also, the unit for extracting aromatic compounds (EA) can be carried out by adsorption or by use of a membrane.

In all of the variants that do not employ a unit for opening naphthene rings, the C7 feedstock can be introduced into a unit for specific dehydrogenation of naphthenes, upstream from the unit for extracting aromatic compounds.

Finally, in some cases, it may be advantageous to place the unit for extracting aromatic compounds so that said unit is fed by the bottom flow of column (CD), whereby the dearomatized effluent of said unit is sent to isomerization unit (IS). This latter variant is shown in dotted lines in FIG. 2.

According to this latter variant, the process diagram is described in the following manner:

The fresh feedstock is introduced into a distillation column (CD) from which are extracted:

a) A top flow (13) that constitutes the isomerate that is produced b) A bottom flow (15) that feeds a unit for extracting aromatic compounds (EA) that makes it possible to produce, on the one hand, a fraction (25) that for the most part contains aromatic compounds, and, on the other hand, an effluent (26) that is introduced into isomerization unit (IS), whereby after stabilization, effluent (18) of the isomerization unit is recycled to distillation column (CD) at a level that is located above the feed level of the column.

In the case where in addition a lateral flow is extracted from the column, the fresh feedstock is introduced into a distillation column (CD) from which are extracted:

a) A top flow that constitutes the isomerate that is produced b) A lateral flow (14) that feeds isomerization unit (IS)

c) A bottom flow (15) that feeds a unit for extracting aromatic compounds (EA) that makes it possible to produce, on the one hand, a fraction (25) that for the most part contains aromatic compounds, and, on the other hand, an effluent (26) that is introduced mixed with flow (14) into isomerization unit (IS), whereby after stabilization, effluent (18) from the isomerization unit is recycled to distillation column (CD) at a level that is located above the outlet level of lateral flow (14).

DETAILED DESCRIPTION OF THE INVENTION

Figure 2:
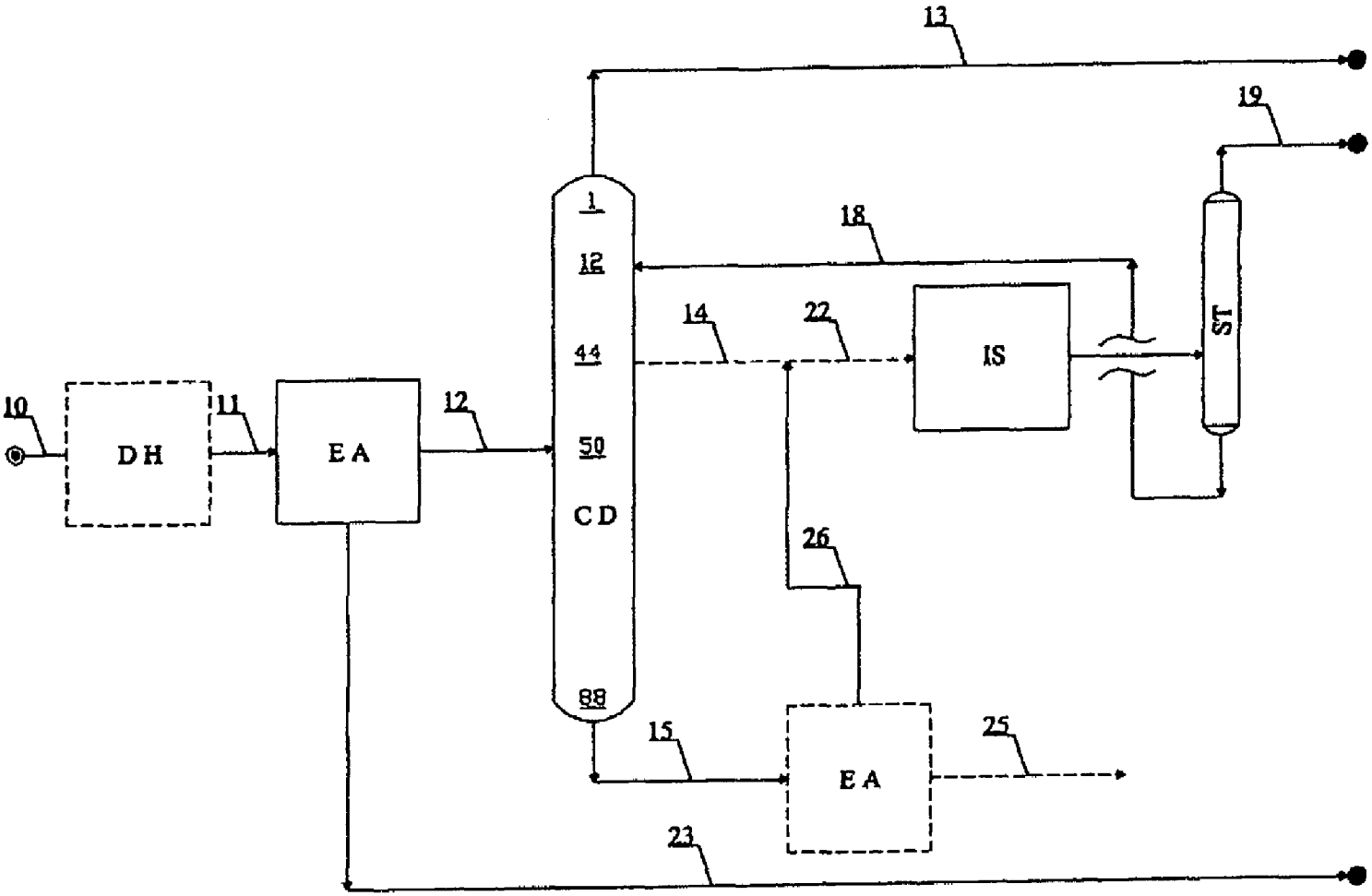
FIG. 2 shows a process diagram according to the invention that employs a distillation column.
Figure 3:
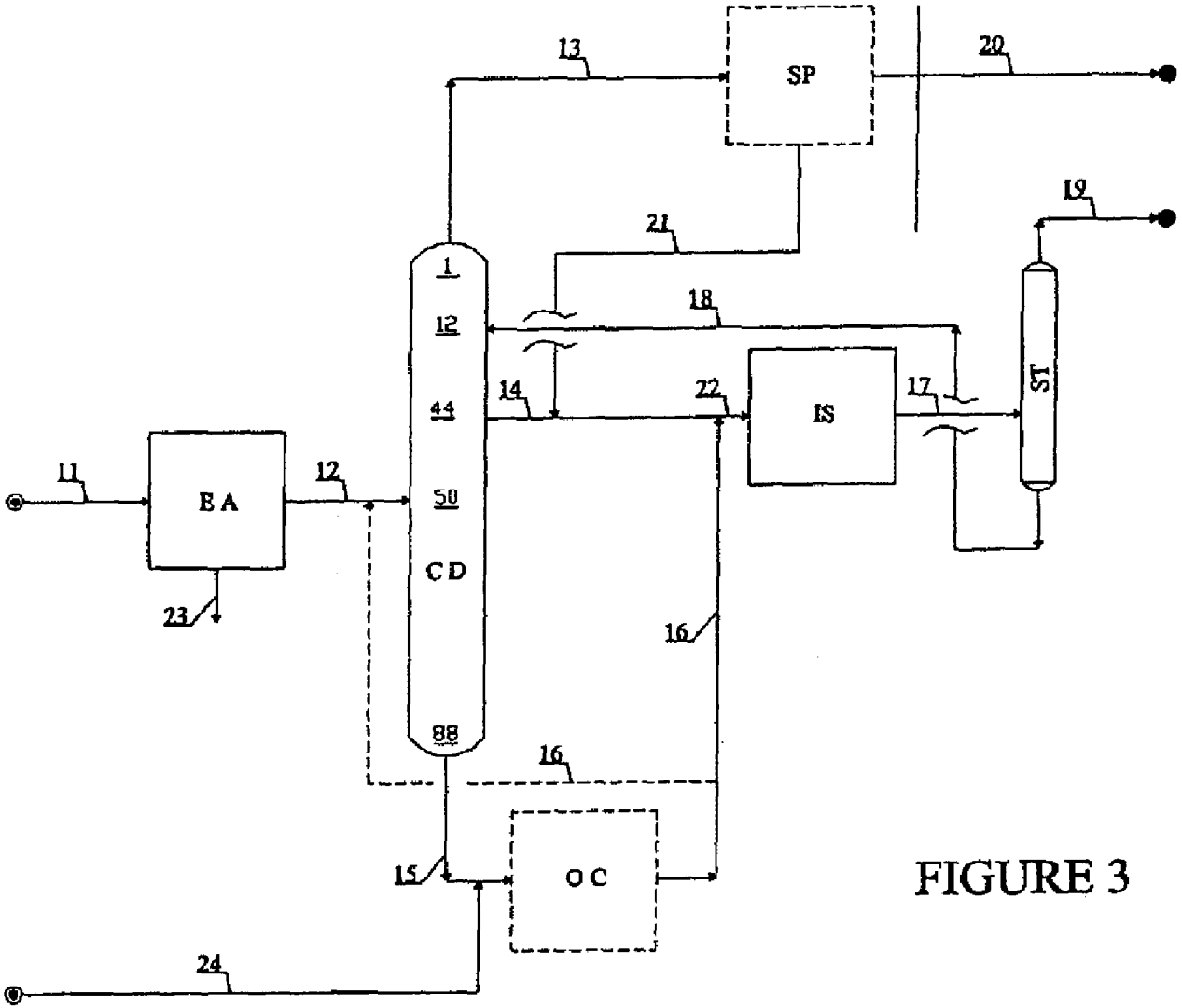
FIG. 3 shows a process diagram according to the invention in its preferred variant that employs a distillation column and that comprises, optionally on the top flow, a unit for separating linear paraffins and mono-branched paraffins, on the one hand, and di- and tri-branched paraffins, on the other hand, and on the bottom flow, a unit for opening naphthene rings.

The detailed description of the invention will be better understood by following the process diagram of FIG. 1 for the first portion of the description, then FIGS. 2 and 3, for the second portion of the description.

The feedstock that is used to illustrate the invention is a C7 fraction that is obtained from an atmospheric distillation naphtha. It has the chemical composition given below:

normal-heptane of 20 to 40% by weight,
methyl-2 hexane of 5 to 15% by weight,
methyl-3 hexane of 10 to 20% by weight,
methyl-cyclohexane of 5 to 30% by weight,
toluene of 4 to 15% by weight.

In the diagram that is described in FIG. 1, fresh feedstock (1) is introduced into a unit for extraction of aromatic compounds (EA) from which is extracted a flow (3) that contains a majority of aromatic compounds and in particular toluene, and a flow (2) that contains a majority of paraffinic and naphthenic compounds that is sent into isomerization unit (IS).

Effluent (5) of the isomerization unit is sent into a stabilization column (ST) that makes it possible to release a flow (6) that consists of light gases at the top.

Effluent (7) of stabilization column (ST) that contains di- and tri-branched paraffins, naphthene rings, but also linear and mono-branched paraffins, is sent into a unit (SP) for separating linear and mono-branched paraffins, on the one hand, and di- and tri-branched paraffins, on the other hand.

Effluent (9) of separation unit (SP) that consists of a majority of di- and tri-branched paraffins constitutes the isomerate, while effluent (8) of separation unit (SP) that consists of a majority of linear and mono-branched paraffins is sent to the isomerization unit mixed with flow (2).

Flow (4) consists of hydrogen for the needs of the isomerization unit that operates under partial hydrogen pressure.

The unit for extracting aromatic compounds (EA) can employ any technique that is known to one skilled in the art. It is possible, for example, to use either a technique for extraction by a solvent, such as DMSO or sulfolane, or a technique for extractive distillation, using a solvent such as N-methylpyrrolidone, or dimethylformamide, or else tetraethylene glycol.

With these processes, it is possible to extract a fraction that has an aromatic compound content of at least 99.0% by weight.

Isomerization unit (IS) makes it possible to transform the normal and mono-branched paraffins into multi-branched paraffins. The isomerization catalyst that is used in said unit will be encompassed in the group that consists of supported catalysts that contain at least one halogen and at least one metal of group VIII, whereby the zeolitic catalysts contain at least one metal of group VIII, Friedel and Krafts catalysts, the superacid catalysts of the type HPA on zirconia, WOx on zirconia, or sulfated zirconia.

The total pressure in the isomerization reaction zone is from about 10 to 50 $10^5$ Pa relative, whereby the hourly volumetric flow rate is about 0.2 at 10 $hour^{-1}$.

The hydrogen/hydrocarbon molar ratio is between 0.06 and 30 mol/mol and preferably between 0.1 and 0.5 mol/mol.

The temperature in the reaction zone is between 50 and 150° C. and preferably between 60 and 100° C.

Unit (SP) for separating the linear and mono-branched paraffins, on the one hand, and di- and tri-branched paraffins, on the other hand, can employ any technique that is known to one skilled in the art.

Among the latter, it is possible to cite the process for adsorption by pressure variation that is known under the abbreviation PSA or the process for separation by simulated countercurrent (CCS).

In the case where separation (SP) is carried out by an adsorption unit, any adsorbent or mixture of adsorbent that has a selectivity in favor of linear and mono-branched paraffins can be used, in particular the zeolitic adsorbents of type MFI, FER, FAU, BEA, EUO, MTT, MEL, FER, AFI, ATO, AEL, NES and MWW, LTA or any adsorbent as described in U.S. Pat. No. 6,353,1444, FR 02/09841 and Patent Application US 20020045793.

Separation by adsorption (SP) can be carried out in gas phase by a PSA- or CCS-type process. In this case, the operating temperature of the unit is between 150 and 400° C. In the case of an implementation with PSA, the pressure of the column during the adsorption phase is between 2 and 30 $10^5$ Pa, and during the desorption phase between 0.5 and 5 $10^5$ Pa.

The desorbent that is used can be a cover gas, such as hydrogen or nitrogen, or a hydrocarbon, such as the C3-C6 paraffins.

The hydrogen is also a desorbent that is particularly well suited for this separation, because it can be directly recycled to the isomerization reactor with the desorbate (effluent of the desorption unit that is rich in normal and branched paraffins).

Such a separation unit (SP) in gas phase makes it possible to produce a RON isomerate that is at least equal to 80.

Alternately, the separation by adsorption (SP) can be carried out in liquid phase by a CCS-type process. In this case, the operating temperature of the unit is between 100 and 250° C. The pressure in the unit is between 2 and 20 $10^5$ Pa.

The desorbent that is used is preferably a hydrocarbon and can be in particular C3-C6 paraffins.

Such a unit for separation by CCS in liquid phase also makes it possible to produce a RON isomerate that is at least equal to 80.

In the variant that is illustrated by FIG. 2, fresh feedstock (11) is introduced into the unit for extracting aromatic compounds (EA) from which is extracted a flow (23) that is rich in aromatic compounds and that for the most part contains toluene, and a flow (12) that is rich in paraffinic and naphthenic compounds that is sent into a distillation column (CD).

The unit for extracting aromatic compounds can employ any technique that is known to one skilled in the art, such as those proposed in the description of FIG. 1.

The values given below are typical values that in no way limit the invention. Distillation column (CD) has one hundred plates, and the feed is carried out in the vicinity of plate 50 (numbered relative to the column top).

The temperature at the top of the column is close to 95° C. for a pressure of 1.5 $10^5$ Pa; the temperature at the bottom of the column is 127° C. for a pressure of 2 $10^5$ Pa.

At the top of column (CD), a flow (13) that is rich in di- and tri-branched paraffins that constitutes the isomerate is extracted.

A bottom flow (15) that optionally can feed the unit for extracting aromatic compounds (EA) when the latter is not fed directly by fresh feedstock (11) is extracted from column (CD).

The effluents of the unit for extracting aromatic compounds are then sent to isomerization unit (IS), optionally mixed with a lateral flow (14).

When the unit for extracting aromatic compounds is fed by fresh feedstock (11), bottom flow (15) is sent directly to isomerization unit (IS).

Optionally, it is possible to extract laterally at plate 44 a lateral flow (14) that contains paraffinic and naphthenic compounds that is sent mixed with the bottom flow of column (15) into isomerization unit (IS). The latter is operated under the same conditions as those provided in the description of FIG. 1.

Effluent (17) of the isomerization unit that contains a flow that is enriched with mono-, di- and tri-branched paraffins is sent into stabilization column (ST) from which at the top there exit a gas-rich fraction (19) and a stabilized effluent (18), i.e., an effluent from which top gases have been removed and that is recycled in distillation column (CD) at a level that is at the top of the level of extracting lateral flow (14).

This flow (18) that contains linear, mono-, di- and tri-branched paraffins will benefit from the effect of separation of column (CD) to the extent that the di- and tri-branched paraffins have a boiling point that is generally less than the one of linear or mono-branched paraffins and will preferably be found at the top of column (CD) to constitute top flow (13).

In a preferred variant of the invention shown by FIG. 3, the diagram of FIG. 2 is repeated and a unit for opening naphthene rings (OC) is added to bottom flow (15) of column (CD), which will produce a paraffin-enriched flow (16) that is sent mixed with lateral flow (14) to isomerization unit (IS).

In another variant, this flow (16) can be sent to feed column (CD) mixed with flow (12).

The unit for opening naphthene rings (OC) makes it possible to transform the naphthenes into linear and branched paraffins. The catalyst that is used in said unit can be any catalyst that makes it possible to convert at least 5% by weight of methylcyclohexane that is present into the mixture to be treated by opening the ring.

The pressure in the reaction zone for opening rings is about 5 to 50 bars relative (1 bar=$10^5$ Pa, the hourly volumetric flow rate is about 0.5 to 20 h−1). The hydrogen/hydrocarbon molar ratio is between 0.5 and 10 mol/mol. The temperature in the reaction zone is between 200 and 400° C., and preferably between 250 and 350° C.

It is also possible to add to the diagram that is illustrated by FIG. 3 a unit for separating linear and mono-branched paraffins, on the one hand, and di- and tri-branched paraffins, on the other hand, fed by top flow (13) and that produces a di- and tri-branched paraffin-enriched effluent (20) that constitutes the isomerate and a linear and mono-branched paraffin-enriched flow (21) that is sent to hydroisomerization unit (IS) mixed with lateral flow (14) and the effluent of the reactor for opening rings (16).

The unit for separating linear and mono-branched paraffins, on the one hand, and di- and tri-branched paraffins, on the other hand, has the same characteristics and operates under the same conditions as those described in the diagram of FIG. 1.

Finally, in a variant of each of the diagrams corresponding to FIG. 1 or 2, it is possible to place a unit for specific dehydrogenation of naphthenes upstream from the unit for extracting aromatic compounds.

This unit, using a catalyst from the group that consists of supported catalysts, contains at least one metal of group VIII and operates under the following conditions:

Pressure: 3 to 15 bars relative

Mean temperature: 350 to 400° C.

PPH: 1 to 10 h−1

Hydrogen/hydrocarbon ratio=2 to 6 mol/mol

EXAMPLE 1

Example 1 illustrates the preferred variant according to FIG. 3 and in addition uses units for base extraction of aromatic compounds (EA) and isomerization (IS), a unit for opening naphthene rings (OC) fed by the bottom flow of the distillation column.

The feedstock to be treated (11) is introduced into a unit for extraction of aromatic compounds (EA) that uses an extractive distillation with N-methylpyrrolidone.

In the example being considered, fresh feedstock (11) has the following composition (in % by weight) and a mass flow rate given below:

| | |
|---|---|
| Dimethyl 2-3 butane | 0.01 |
| Methyl-2 pentane | 0.13 |
| Methyl-3 pentane | 0.17 |
| n-Hexane | 1.41 |
| Methyl-cyclopentane | 0.60 |
| Cyclohexane | 1.73 |
| Benzene | 0.33 |
| Trimethyl 2-2-3 butane | 0.08 |
| Dimethyl 2-2 pentane | 0.20 |
| Dimethyl 2-3 pentane | 3.56 |
| Dimethyl 2-4 pentane | 0.49 |
| Dimethyl 3-3 pentane | 0.25 |
| Methyl-2 hexane | 8.99 |
| Methyl-3 hexane | 12.24 |
| Ethyl-3 pentane | 1.14 |
| n-Heptane | 31.45 |
| Dimethyl-1,1 cyclopentane | 0.82 |
| cis-Dimethyl-1,3 cyclopentane | 2.29 |
| trans-Dimethyl-1,3 cyclopentane | 2.21 |
| trans-Dimethyl-1,2 cyclopentane | 4.19 |
| Methyl-cyclohexane | 12.97 |
| Ethyl-cyclopentane | 0.73 |
| Toluene | 13.51 |
| $C_{8+}$ | 0.50 |
| Total flow rate (kg/hour) | 11078 |

In the example being considered, the fraction that is rich in aromatic compounds (23) has the following composition (in % by weight) and a mass flow rate given below:

| | |
|---|---|
| Benzene | 2.37 |
| Toluene | 97.03 |
| Other compounds | 0.60 |
| Total flow rate (kg/hour) | 1527 |

With an extractive distillation with N-methylpyrrolidone, it is possible, as in this example, to recover 99% of aromatic compounds and to obtain a fraction with a purity of more than 99%.

Flow (12) rich in paraffinic and naphthenic compounds obtained by the unit for extraction of aromatic compounds from the feedstock is sent to a distillation column (CD) comprising 88 real plates at plate 50. The composition by weight and the mass flow rate of this flow (12) are as follows:

| | |
|---|---|
| Dimethyl 2-3 butane | 0.02 |
| Methyl-2 pentane | 0.14 |
| Methyl-3 pentane | 0.18 |
| n-Hexane | 1.63 |
| Methyl-cyclopentane | 0.70 |
| Cyclohexane | 2.01 |
| Benzene | 0.00 |
| Trimethyl 2-2-3 butane | 0.09 |
| Dinmethyl 2-2 pentane | 0.24 |
| Dimethyl 2-3 pentane | 4.13 |
| Dimethyl 2-4 pentane | 0.57 |
| Dimethyl 3-3 pentane | 0.29 |
| Methyl-2 hexane | 10.42 |
| Methyl-3 hexane | 14.19 |
| Ethyl-3 pentane | 1.31 |
| n-Heptane | 36.42 |
| Dimethyl-1,1 cyclopentane | 0.95 |

-continued

| | |
|---|---|
| cis-Dimethyl-1,3 cyclopentane | 2.66 |
| trans-Dimethyl-1,3 cyclopentane | 2.57 |
| trans-Dimethyl-1,2 cyclopentane | 4.86 |
| Methyl-cyclohexane | 15.03 |
| Ethyl-cyclopentane | 0.85 |
| Toluene | 0.16 |
| $C_{8+}$ | 0.58 |
| Total flow rate (kg/hour) | 9551 |

At the top of column (CD), a flow (13) comes out that corresponds to the isomerate that is produced when an additional unit is not added for separation of normal and mono-branched paraffins, on the one hand, and di-branched paraffins, on the other hand.

The composition by weight and the mass flow rate of this flow 13 are as follows:

| | |
|---|---|
| Isopentane | 3.15 |
| Dimethyl 2-2 butane | 0.20 |
| Dimethyl 2-3 butane | 0.17 |
| Methyl-2 pentane | 0.81 |
| Methyl-3 pentane | 0.53 |
| n-Hexane | 2.19 |
| Methyl-cyclopentane | 1.13 |
| Cyclohexane | 2.07 |
| Benzene | 0.00 |
| Trimethyl 2-2-3 butane | 7.15 |
| Dimethyl 2-2 pentane | 21.94 |
| Dimethyl 2-3 pentane | 1.19 |
| Dimethyl 2-4 pentane | 45.79 |
| Dimethyl 3-3 pentane | 3.64 |
| Methyl-2 hexane | 6.14 |
| Methyl-3 hexane | 2.58 |
| Ethyl-3 pentane | 0.08 |
| n-Heptane | 0.50 |
| Dimethyl-1,1 cyclopentane | 0.24 |
| cis-Dimethyl-1,3 cyclopentane | 0.10 |
| trans-Dimethyl-1,3 cyclopentane | 0.08 |
| trans-Dimethyl-1,2 cyclopentane | 0.07 |
| Methyl-cyclohexane | 0.25 |
| Ethyl-cyclopentane | 0.00 |
| Toluene | 0.00 |
| $C_{8+}$ | 0.00 |
| Total flow rate (kg/hour) | 7893 |

The RON of this isomerate (flow 13) is 82.8, and its aromatic compound content is less than 0.01% by weight.

At plate 44, a flow (14) that contains a majority (at least 60%) of normal-heptane and mono-branched C7 paraffins is drawn off.

At the bottom of column (CD), a flow (15) that is rich in methylcyclohexane and n-heptane is drawn off.

This flow (15) is sent into a unit for opening rings (OC) that produces an effluent (16) that primarily contains a mixture of paraffins partly resulting from the opening of the rings, as well as the unconverted methyl-cyclohexane.

In this example, the unit for opening rings uses a catalyst with an iridium base that is deposited on alumina or silica-alumina, such as the one described in Application WO 02/07881.

The ring-opening unit is operated under the following conditions:

Temperature=300° C.

Pressure=14 bars.eff

PPH=10 $hour^{-1}$

Hydrogen/hydrocarbon molar ratio=6 mol/mol

The composition by weight and the mass flow rate (beyond hydrogen) of flow (16) corresponding to the effluent of the ring-opening cycle are as follows:

| | |
|---|---|
| $C_{5-}$ | 1.83 |
| $C_5$ paraffins | 3.71 |
| $C_6$ paraffins | 1.72 |
| Methyl-cyclopentane | 0.00 |
| Cyclohexane | 0.00 |
| Benzene | 0.00 |
| $C_7$ paraffins | 78.32 |
| Dimethyl-1,1 cyclopentane | 0.39 |
| cis-Dimethyl-1,3 cyclopentane | 0.37 |
| trans-Dimethyl-1,3 cyclopentane | 0.40 |
| trans-Dimethyl-1,2 cyclopentane | 0.40 |
| Methyl-cyclohexane | 11.51 |
| Ethyl-cyclopentane | 0.39 |
| Toluene | 0.18 |
| $C_{8+}$ | 0.78 |
| Total flow rate (kg/hour) | 6891 |

Flow (16) is mixed with flow (14) to provide a flow (22) that is introduced into an isomerization unit (IS) that uses a platinum-based catalyst on chlorinated alumina as described in Patent Application US 2002/0002319 A1.

The isomerization unit operates under the following conditions:

Temperature=90° C.

Pressure=30 bars.eff

PPH=1 hour$^{-1}$

Hydrogen/hydrocarbon molar ratio=0.2 mol/mol.

The composition by weight and the mass flow rate (apart from hydrogen) of flow (17) corresponding to the effluent of the isomerization unit are as follows:

| | |
|---|---|
| $C_{5-}$ | 2.48 |
| Isopentane | 0.37 |
| Dimethyl 2-2 butane | 0.02 |
| Dimethyl 2-3 butane | 0.02 |
| Methyl-2 pentane | 0.08 |
| Methyl-3 pentane | 0.04 |
| n-Hexane | 0.10 |
| Methyl-cyclopentane | 0.07 |
| Cyclohexane | 0.18 |
| Benzene | 0.00 |
| Trimethyl 2-2-3 butane | 1.66 |
| Dimethyl 2-2 pentane | 3.32 |
| Dimethyl 2-3 pentane | 4.15 |
| Dimethyl 2-4 pentane | 8.30 |
| Dimethyl 3-3 pentane | 4.15 |
| Methyl-2 hexane | 22.40 |
| Methyl-3 hexane | 16.59 |
| Ethyl-3 pentane | 0.83 |
| n-Heptane | 21.57 |
| Dimethyl-1,1 cyclopentane | 0.30 |
| cis-Dimethyl-1,3 cyclopentane | 0.29 |
| trans-Dimethyl-1,3 cyclopentane | 0.31 |
| trans-Dimethyl-1,2 cyclopentane | 0.30 |
| Methyl-cyclohexane | 12.17 |
| Ethyl-cyclopentane | 0.30 |
| Toluene | 0.00 |
| $C_{8+}$ | 0.00 |
| Total flow rate (kg/hour) | 66802 |

Effluent (17) of the isomerization unit is sent into a stabilization column (57) from which a flow (19) exits at the top, whereby said flow (19) comprises light gases that result from cracking reactions within the isomerization unit ($C_{5-}$fraction), and a flow (18) exits at the bottom, said flow (18) whose composition is very close to that of flow (17) and which is reintroduced at the top of column (CD) at the level of plate 12.

The mass flow rate (apart from hydrogen) of flow (19) rises to 1658 kg/h.

It is possible to verify that the mass flow rate of flow (11) is equal to the sum of mass flow rates (apart from hydrogen) of flows (23), (13), and (19).

In conclusion, the detailed example above shows that it is possible to produce a RON isomerate that is greater than 80 (82.8) and containing less than 0.5% by weight (0.01%) of aromatic compounds and to co-produce a toluene-rich aromatic fraction (97% by weight) starting from a C7 feedstock that contains 61% paraffins, 25% naphthenes and 14% aromatic compounds.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure[s] of all applications, patents and publications, cited herein and of corresponding French application No. 04/09.999, filed Sep. 22, 2005, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of a RON isomerate that is at least equal to 80 and for co-production of an aromatic fraction that for the most part contains toluene, staffing from a C7 fraction containing paraffins, naphthenes and aromatic compounds in any proportion, whereby said process employs at least one step comprising passing fresh feedstock (11) into an extractive distillation unit for extracting aromatic compounds (EA) so as to produce an aromatic fraction (23) containing mostly toluene, and a dearomatized C7 fraction (12) that is introduced into a distillation column (CD) from which are extracted:

a) A top flow (13) that constitutes an isomerate produced in isomerization unit (IS), b) A lateral flow (14) that feeds isomerization unit (IS), c) A bottom flow (15), at least in part feeds a unit for opening naphthene rings (OC) from which is extracted an effluent (16) that is sent at least in part to isomerization unit (IS), within said isomerization unit (IS), conducting at least one step of isomerization of linear paraffins and mono-branched paraffins into multi-branched paraffins wherein the resultant isomerate contains less than 1% by weight of aromatic compounds, and at least one step of separating resultant stream of linear and mono-branched paraffins from di- and tri-branched paraffins.

2. A process according to claim 1, further comprising an effluent (16) from the naphthene ring opening unit (OC) in part to feed column (CD) and mixed with flow (12).

3. A process according to claim 1, wherein the top flow (13) of distillation column (CD) is sent into a unit (SP) for separating normal and mono-branched paraffins, on the one hand, and di- and tri-branched paraffins, on the other hand, and reintroducing resultant normal and mono-branched paraffins (21) into isomerization unit (IS), and wherein the di- and tri-branched paraffins (20) constitute the isomerate having an RON greater than 80.

4. A process according to claim 1, wherein distillation column (CD) is of the column type with an internal wall.

5. A process according to claim 3, wherein the separation of the linear and mono-branched paraffins, on the one hand, and di- and tri-branched paraffins, on the other hand, is conducted by pressure swing adsorption (PSA).

6. A process according to claim 3, wherein the separation of the linear and mono-branched paraffins, on the one hand, and di- and tri-branched paraffins, on the other hand, conducted by simulated countercurrent adsorption (CCS).

7. A process according to claim 1, further comprising a preceding step, wherein the C7 feedstock is introduced into a unit for specific dehydrogenation of naphthenes, upstream from the unit for extracting aromatic compounds.

8. A process according to claim 1, wherein the resultant isomerate contains less than 0.5% by weight of aromatic compounds.

9. A process according to claim 1, wherein effluent (17) from the isomerization is subjected to stabilization in a column so as to remove gases at the top of the column and to obtain a stabilized flow (18) at the bottom of the column which has a composition similar to that of effluent (17).

10. A process according to claim 1, further comprising recycling the linear and mono-branched paraffins from said step of separating to the inlet of the isomerization unit (15) and mixed with said dearomatized effluent.

11. A process according to claim 1, further comprising after optional stabilization, effluent from the isomerization unit is recycled to distillation column (CD) at a level that is located above the feed level of the column.

12. A process according to claim 1, further comprising after any stabilization, effluent from the isomerization unit is recycled to distillation column (CD) at a level that is located above the outlet level of lateral flow (14).

13. A process according to claim 1, further comprising effluent (18) from the isomerization unit is subjected to stabilization and then recycled to distillation column (CD) at a level that is located above the outlet level of lateral flow (14).

14. A process according to claim 1, wherein the aromatic fraction contains above 97% toluene.

15. A process according to claim 3, wherein the aromatic fraction contains above 97% toluene.

* * * * *

UNITED STATES PATENT AND TRADEMARK OFFICE

CERTIFICATE OF CORRECTION

PATENT NO. : 7,612,246 B2
APPLICATION NO. : 11/232108
DATED : November 3, 2009
INVENTOR(S) : Broutin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1077 days.

Signed and Sealed this

Nineteenth Day of October, 2010

David J. Kappos

David J. Kappos
*Director of the United States Patent and Trademark Office*